US005192820A

United States Patent [19]

Kawamura et al.

[11] Patent Number: 5,192,820

[45] Date of Patent: Mar. 9, 1993

[54] MUSICAL INSTRUMENT KEYBOARD STRIKING FORCE SENSOR

[75] Inventors: Kiyoshi Kawamura; Shigeru Muramatsu, both of Hamamatsu, Japan

[73] Assignee: Yamaha Corporation, Hamamatsu, Japan

[21] Appl. No.: 722,685

[22] Filed: Jun. 28, 1991

[30] Foreign Application Priority Data

Jun. 28, 1990 [JP] Japan ..... 2-170590

[51] Int. Cl.[5] ..... G10C 3/18

[52] U.S. Cl. ..... 84/236; 84/724

[58] Field of Search ..... 84/626, 658, 687-690, 84/723, 724, 236, 240, 244, 245, 246, 462, 463

[56] References Cited

U.S. PATENT DOCUMENTS 4,736,662 4/1988 Yamamoto ..... 84/724

*Primary Examiner*—Michael L. Gellner
*Assistant Examiner*—Howard B. Blankenship
*Attorney, Agent, or Firm*—Spensley Horn Jubas & Lubitz

[57] ABSTRACT

A key striking force sensor suitable for player pianos.

This sensor contains a displacement sensor for measuring displacement between the displacement sensor itself and a catcher which rocks together with a hammer. As the positions of the catchers corresponding to the hammer respectively are almost the same, plural of the displacement sensors can be mounted on a common circuit board. Accordingly, mechanical construction thereof is comparatively simpler than that of conventional player pianos.

12 Claims, 6 Drawing Sheets

MUSICAL INSTRUMENT KEYBOARD STRIKING FORCE SENSOR

BACKGROUND OF THE INVENTION

1. Field of the Invention

The present invention relates to keyboard instruments, and more particularly, to automatic playing keyboard instruments and devices for assessing characteristics of a performer's operation of keys on the keyboard of such an instrument.

2. Prior Art

Automatic playing keyboard instruments such as automatic playing (player) pianos conventionally incorporate means for quantifying the force with which keys are depressed and other characteristics of a performance, in this way making it possible to record data expressing various aspects of a performance on the instrument which can be later reproduced so as to provide for automatic playback which faithfully duplicates the original performance.

With conventional automatic playing pianos, each key on the keyboard has a corresponding dedicated hammer mechanism just as is the case with an ordinary manual piano. With the automatic playing instrument, each hammer mechanism further includes a shutter which moves in concert with the corresponding hammer, and a pair of photocells which are situated such that movement of the hammer and hence the shutter results in momentary occlusion of light incident on one of the photocells, and then occlusion light incident on the other, in this way making it possible to measure the velocity with which a key is depressed.

With conventional means for measuring the velocity with which a hammer mechanism moves, however, because only a single distance interval is measured, only a simple averaged value of the hammer velocity is obtained. As a result, the finer nuances of a performance cannot be readily assessed for which reason the fidelity of reproduction on automatic playback suffers.

Furthermore, because the measured time interval is short, the orientation of the photocells and shutter incorporated into each hammer mechanism is quite critical. For this reason, assembly and calibration for all eighty-eight keys on a conventional keyboard is cumbersome and time consuming, with the result that these conventional instruments tend to be expensive. Additionally, this type of mechanism is prone to loss of alignment with time, resulting in increased maintenance requirements and expenses.

SUMMARY OF THE INVENTION

In consideration of the above, it is a primary object of the present invention to provide striking intensity measuring apparatus for keyboard instruments which can measure the hammer speed with high precision and which can be efficiently assembled and maintained.

To achieve this object, the present invention provides a key striking force sensor including:

(a) displacement measuring means for measuring displacement of a component of a hammer mechanism which moves in concert with the associated hammer mechanism; and (b) calculation means for calculating velocity or acceleration of movement of the hammer mechanism based on displacement data from the above described displacement measuring means.

DESCRIPTION OF THE PREFERRED EMBODIMENT

In the following, a preferred embodiment of the present invention will be described with reference to the appended drawings. The description of the present embodiment is made with reference to an upright piano 1 wherein eighty-eight instances of a striking force sensor in accordance with the present invention are implemented, each as a component of a respective hammer mechanism out of the eighty-eight hammer mechanisms incorporated in piano 1, each hammer mechanism corresponding to one note of an eighty-eight note half tone scale.

Figure 1:
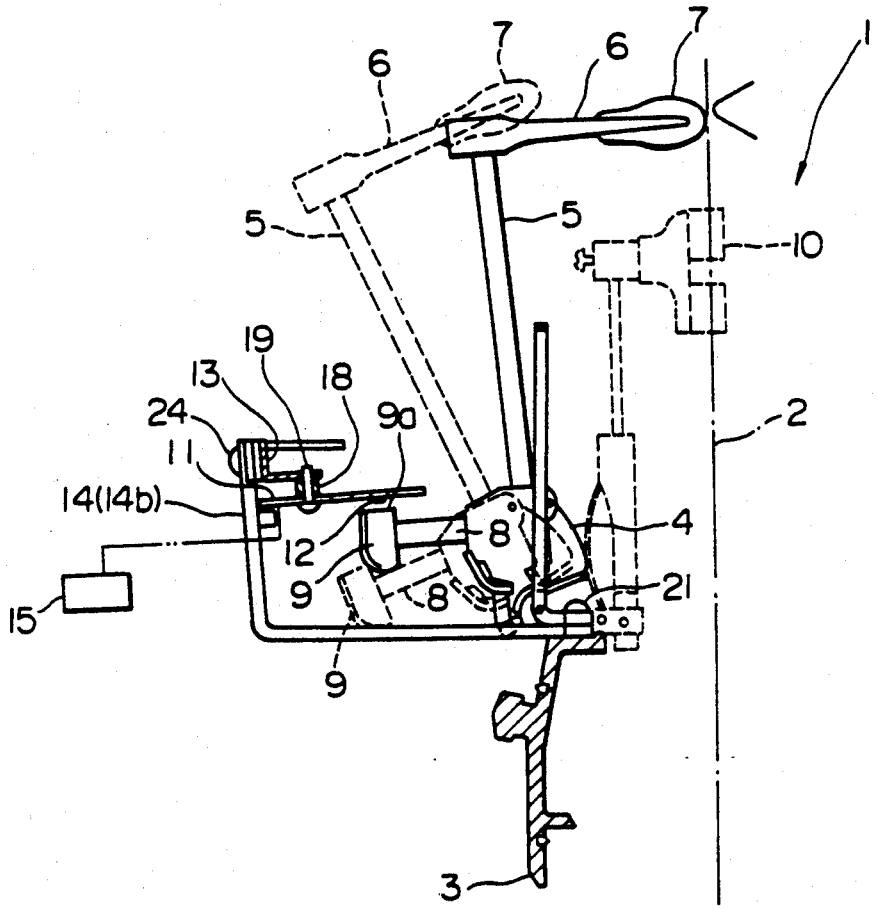
FIG. 1 is a cross-sectional view of a hammer mechanism of a player piano fitted with a key striking force sensor for keyboard instruments according to an embodiment of the present invention.

In FIG. 1, a hammer mechanism for a single string 2 is shown from the side, mounted on a horizontal mounting rail 3, on which each of the other hammer mechanisms of the piano 1 are likewise mounted. The mechanism consists of a pivot 4 mounted on the mounting rail 3 so as to freely pivot thereon. A hammer shank 5 projects upward from pivot 4, with a hammer head 6 mounted on the distal end thereof. A felt layer 7 covers the striking surface of the hammer head 6. At an angle of approximately 90 degrees with respect to the hammer shank 5, a catcher shank 8 projects outward from butt 4 and away from string 2. At the distal end of the catcher shank 8, a catcher 9 is mounted thereon. In proximity to string 2, a damper block 10 can be seen in FIG. 1 at a position intermediate between the hammer head 6 and the butt 4, which is a component of a damping mechanism (not shown) mechanically coupled with the hammer mechanism.

Figure 2:
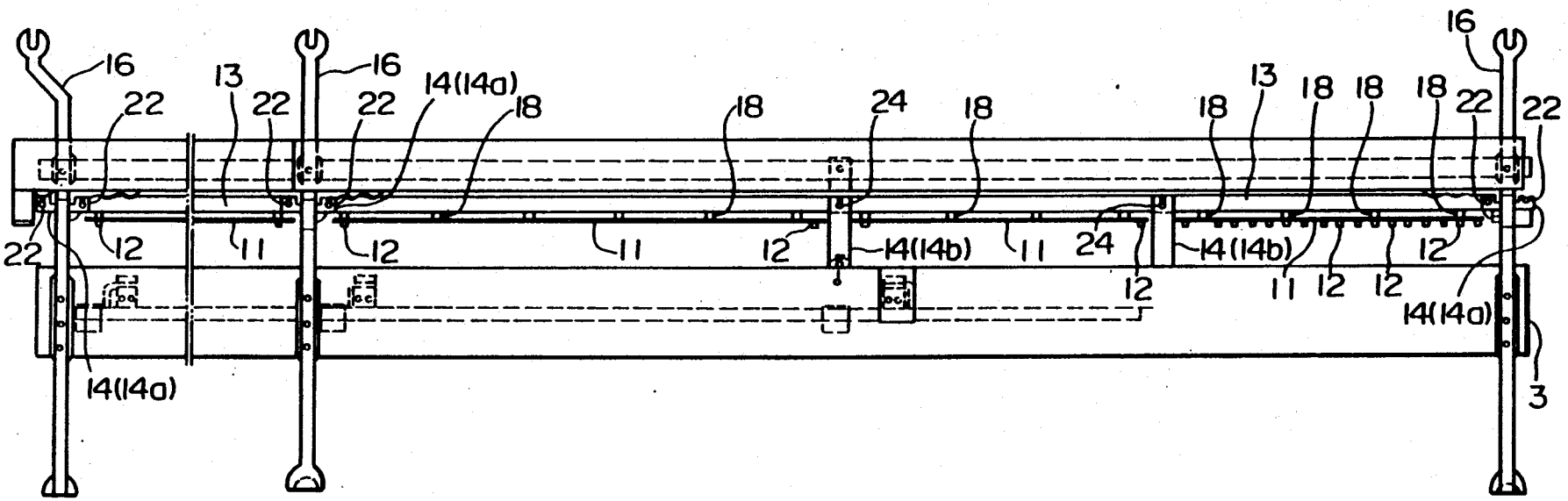
FIG. 2 is a front view of the key striking force sensor shown in FIG. 1.

As best seen in FIG. 2, multiple elongated PCBs (printed circuit boards) 11 are consecutively mounted on a support rail 13 which in turn is mounted on the mounting rail 3 via short brackets 14 and long brackets 16, such that the PCBs 11 lie approximately within a horizontal plane. Each PCB 11 includes multiple sensors 12 arranged in a single row, each of which corresponds to a single hammer mechanism which is in immediate proximity thereto. Each sensor 12 incorporates a light source and a photo-sensor as integral components thereof, lying adjacent to each other on a single surface of the sensor. The light source and the photo-sensor can be suitably selected from those that respectively generate and detect visible light or infrared light.

Figure 3:
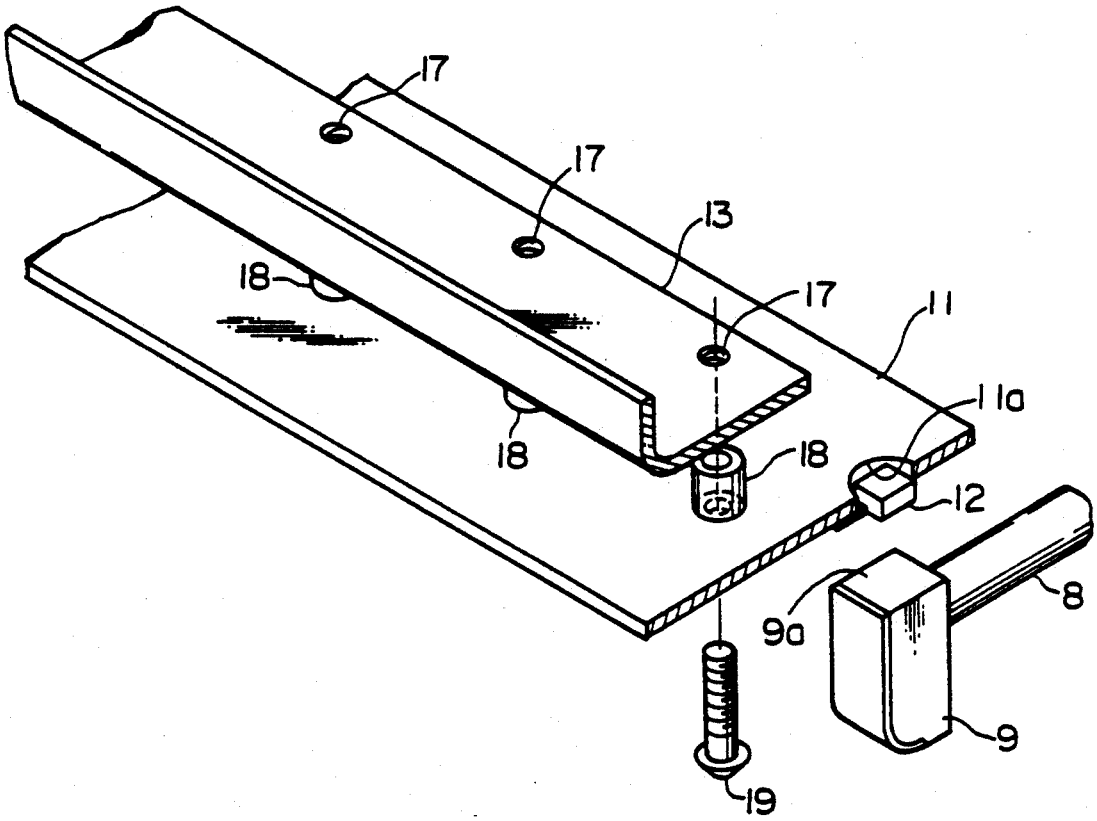
FIGS. 3 and 4 are enlarged perspective views of the key striking force sensor.

As shown in FIG. 3, each displacement sensor 12 is mounted in a respective through hole 11*a* in a PCB 11 in such manner that the light source and photo-sensor thereof face the upper surface 9*a* of a corresponding catcher 9. Further, each sensor 12 is electrically connected with a corresponding calculation circuit 15 as is shown in FIG. 1.

The support rail 13 has an "L" shaped form when viewed in cross-section, and includes multiple threaded holes 17 along its length. A spacer 18 is located between the support rail 13 and the adjacent PCB 11 at each threaded hole 17. The PCBs 11 are mounted on the support rail 13 using multiple bolts 19, each of which passes through a corresponding hole in the PCB 11 and corresponding the spacer 18, and then is screwed into the corresponding threaded hole 17 in the support rail 13. In this way, a gap equal to the height of the spacers 18 is formed between each PCB 11 and the support rail 13.

Figure 4:
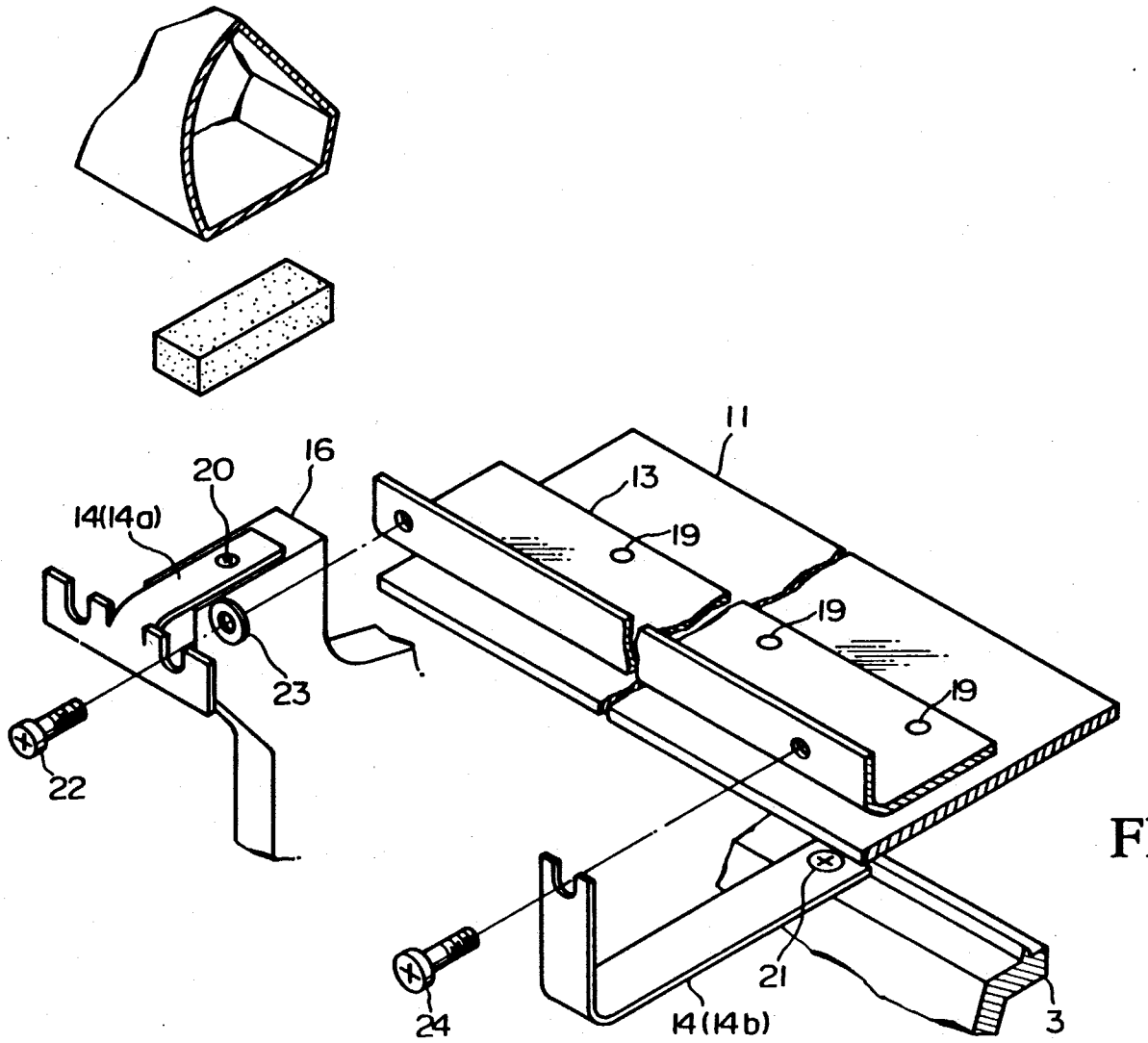

As shown in FIGS. 2 and 4, each short bracket 14 includes an end bracket 14*a* which is fixed to a long bracket 16 with bolts 20, and an intermediate bracket 14*b* which is fixed to the center-rail 3 with bolts 21. The end bracket 14*a* is further fixed with an end of the support rail 13 with a bolt 22 and a nut 23, and the intermediate bracket 14*b* is further fixed at an intermediate point of the support rail 13 with a bolt 24.

Figure 5:
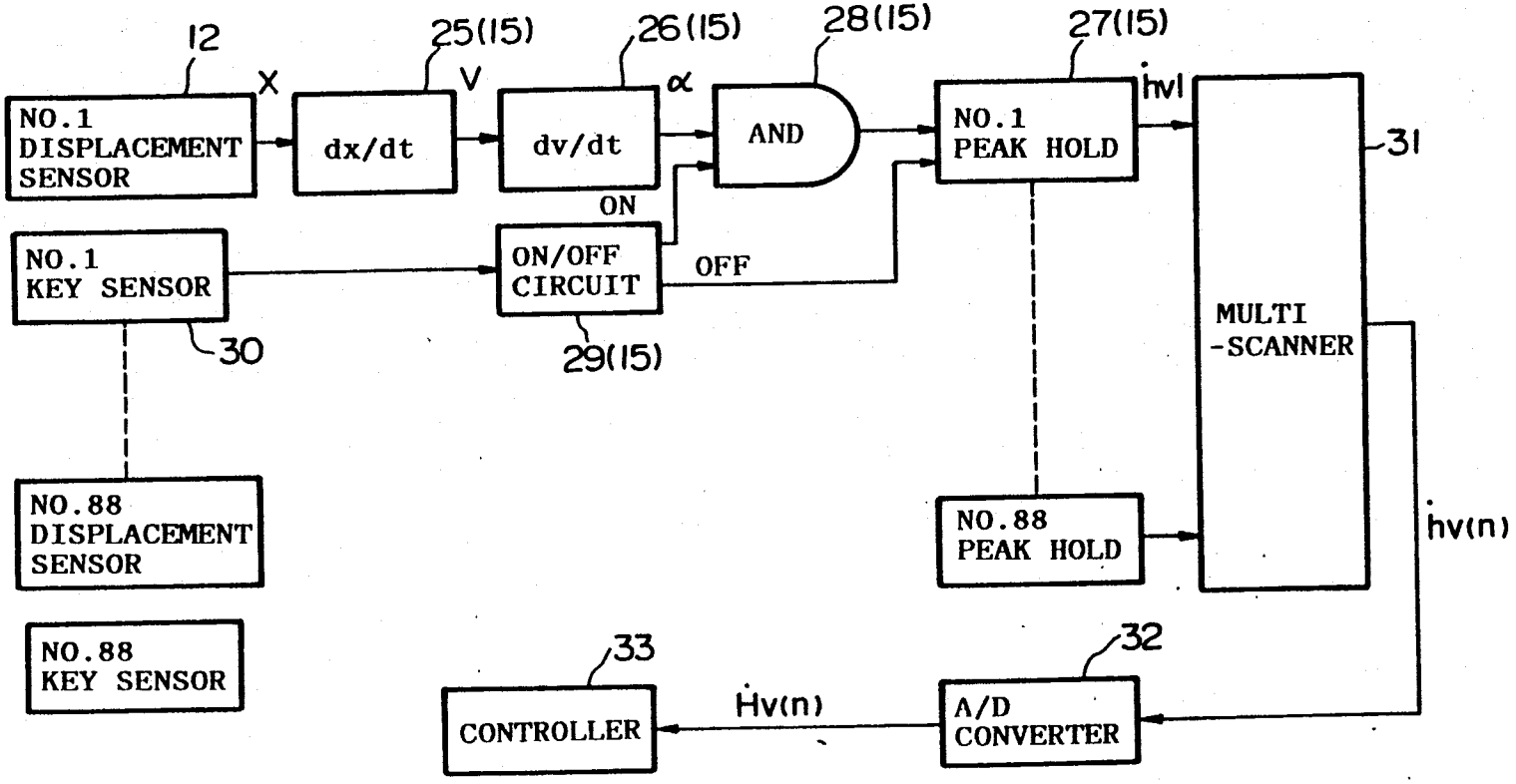
FIG. 5 is a block diagram showing electronic configuration of the key striking force sensor.

In the following, details of the calculation circuit 15 and associated circuits will be described. As pictured in FIG. 5, the calculation circuit 15 includes a differentiating circuit 25 which differentiates a displacement signal X output from a corresponding displacement sensor 12, whereby a velocity signal V is generated, where $V=dX/dt$. The output of differentiating circuit 25 is again differentiated in a differentiating circuit 26, whereby an acceleration signal $\alpha$ is generated, where $\alpha=dV/dt$. The maximum value of the output signal of differentiating circuit 26 is temporarily stored in a peak-holding circuit 27 after first passing through an AND circuit 28 which inserted between the differentiating circuit 26 and the peak-holding circuit 27.

Each key on the keyboard is connected with a corresponding key sensor 30 via an ON/OFF circuit 29, the output of which is supplied to the AND gate 28 and the peak-holding circuit 27. When a key sensor 30 detects key operation of a corresponding key, the ON/OFF circuit 29 outputs a key-on signal to the AND circuit 28, as a result of which, the output of differentiating circuit 26 is supplied to the corresponding peak-holding circuit via AND gate 28.

ON/OFF circuit 29 is also connected to the peak-holding circuit 27 and outputs a key-off signal thereto when the corresponding key is released up to a predetermined amount. The peak-holding circuit 27 is cleared when the key-off signal is received.

A differentiating circuit 25 and 26, peak-holding circuit 27, AND gate 28 and ON/OFF circuit 29 are provided for each of the eighty-eight keys of the automatic playing piano. The output signals from all of the peak-hold circuits 27 are supplied to a multi-scanner 31.

The multi-scanner 31 is connected to a controller 33 via an A/D (analog/digital) converter 32. The controller 33 then outputs the measured peak levels of acceleration signals $\alpha$ corresponding to the operated keys in digital form.

In the following, an example of the operation of this embodiment will be described.

(1) INITIAL CALIBRATION DURING MANUFACTURE

First of all, a test depression is carried out for each key wherein typically a light, medium and strong depression are applied, while simultaneously, the peak level of the acceleration signal $\alpha$ for each depression is measured. Once these peak voltage values are measured, the corresponding solenoid which drives that key during automatic play is supplied with varying test voltages so as to determine a low voltage, medium voltage and high voltage which reproduces the peak acceleration values obtained by light, medium and strong depression of that key, respectively.

Based on the voltage data obtained as described above, the manufacturer prepares a table in nonvolatile memory, for example, ROM representing the correspondence between the peak levels of the acceleration signal $\alpha$ and the test voltages for each key.

(2) OPERATION DURING PERFORMANCE RECORDING

When a key is depressed by a performer, the catcher 9 corresponding to the depressed key approaches the corresponding displacement sensor 12, while simultaneously, the displacement X up to the top surface 9*a* of catcher 9 is measured by the displacement sensor 12. Based on the measured values for displacement X, velocity signal V is calculated and output from differentiating circuit 25, and acceleration signal $\alpha$ is generated by the differentiating circuit 26. The depression of the key will have been detected by the key sensor 30, and as a result, the ON/OFF circuit 29 outputs a key-on signal to AND gate 28. AND gate 28 the passes the acceleration signal $\alpha$ supplied thereto to peak-holding circuit 27. Then, the peak level of the acceleration signal $\alpha$ which is held by the peak-hold circuit 27 is then supplied to controller 33 via multi-scanner 31 and A/D converter 32.

Controller 33 then outputs the peak level of the acceleration signal $\alpha$ to a recording device (not shown) such as a floppy-disk, together with other data such as tone-pitch, note-on and note-off data, etc. The recording device then records the supplied data as is the case with conventional player pianos.

When the corresponding key is released, a key-off signal is supplied from the ON/OFF circuit 29 to the peak-hold circuit 27, whereby the held value therein is cleared.

Figure 6:
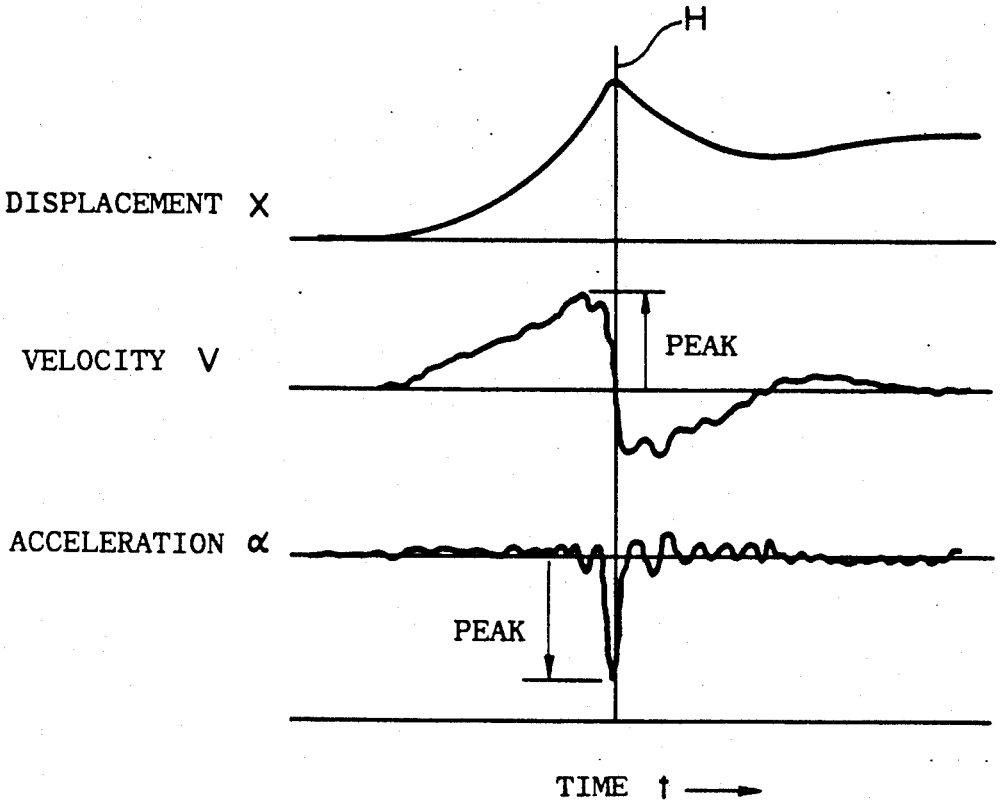
FIG. 6 is a conceptual diagram showing waveforms of a displacement signal X, a velocity signal V and an acceleration signal $\alpha$ in the embodiment.

As described above, this embodiment records the peak level of the acceleration signal $\alpha$, not the peak level of the velocity signal V. This is because the peak acceleration value demonstrates a closer correspondence to the force with which a string is struck by a hammer than does the peak velocity value. Further, the timing of the peak acceleration more nearly coincides with the time at which the hammer strikes the string, as can be seen in FIG. 6.

If a less precise assessment of striking force is acceptable, the peak value for velocity signal V can be determined and stored instead of the peak of the acceleration signal $\alpha$. In this case, the differentiating circuit 26 is unnecessary and the velocity signal V output from the differentiating circuit 25 can be directly supplied to AND circuit 28. Further, in this case, the ROM should store data describing the correspondence between the peak levels of the velocity signal V and the test voltages.

(3) OPERATION DURING PERFORMANCE REPLAY

During automatic replay, the previously recorded performance data is read out from the recording device, on which basis the keys and pedals (not shown) of the piano 1 are operated. Among the performance data, the peak levels of the acceleration signal $\alpha$ or the peak levels of the velocity signal V are converted to voltage values according to the data table stored in ROM. Even though the data in ROM shows only correspondence of three cases (i.e. light, medium and hard depressions), it is easy to obtain suitable voltages corresponding to other depression forces by means of interpolation.

As described previously, this embodiment of the invention has a number of advantages. First, the displacement sensor 12 directly measures the distance between catcher 9 and sensor 12 itself, this distance proportional to the distance between the striking surface of a corresponding hammer up to the corresponding string 2. This is measured as a continuously varying analog value which permits significantly more accurate duplication of hammer motion during replay, as compared with the shutter and photocell system employed in conventional instruments.

Further, the striking force sensor of this embodiment is simple in structure, compact, and can be uniformly constructed for each key, in this way significantly reducing manufacturing costs. Additionally, the structure is relatively more stable than devices which incorporate shutters and the like, for which reason maintenance costs for periodic calibration are eliminated.

Because the sensor 12 for each hammer mechanism is identical, and the position for each sensor 12 relative to its corresponding hammer mechanism is identical, modular construction using the PCBs 11 is possible, thus further reducing manufacturing overhead.

This invention may be practiced or embodied in other ways than has been described herein without departing from the spirit or essential character thereof. Therefore, the preferred embodiment described herein is illustrative and not restrictive, the scope of the invention being indicated by the appended claims, and all variations which come within the meaning of the claims are intended to be embraced therein.

What is claimed is:

1. A key striking force sensor including:

(a) displacement measuring means for continuously measuring displacement of a component of a hammer mechanism over an entire range of motion, the component moving in concert with the hammer mechanism; and (b) calculation means for calculating velocity or acceleration of movement of the hammer mechanism based on displacement data from the displacement measuring means.

2. A key striking force sensor according to claim 1, wherein the displacement measuring means is located above a catcher, whereby the displacement measuring means measures displacement of a top surface of the catcher.

3. A key striking force sensor according to claim 1, wherein the displacement measuring means is fitted on a printed circuit board, the printed circuit board including an action bracket.

4. A key striking force sensor according to claim 1, wherein the calculation means includes first differentiating means for differentiating the displacement in order to determine velocity.

5. A key striking force sensor according to claim 4, wherein the calculation means further includes second differentiating means for differentiating the velocity in order to determine acceleration.

6. A key striking force sensor according to claim 1, wherein the displacement measuring means is fitted on a surface perpendicular to a direction of movement of the component and facing the component.

7. A key striking force sensor, comprising:

displacement measuring means for measuring displacement of a hammer mechanism and for producing displacement data representative of the displacement of the hammer mechanism over an entire range of motion; and calculation means for calculating velocity and acceleration data for the hammer mechanism based on the displacement data from the displacement measuring means.

8. A key striking force sensor according to claim 7, wherein the hammer mechanism defines a portion which moves in concert with the hammer mechanism and the displacement measuring means measures the displacement of the portion.

9. A key striking force sensor according to claim 8, wherein the portion of the hammer mechanism which moves in concert with the hammer mechanism comprises a catcher, the displacement measuring means is located in spaced relation to the catcher, and the displacement measuring means measures the displacement of a top surface of the catcher.

10. A key striking force sensor according to claim 7, wherein the displacement measuring means is operably connected to a printed circuit board, the printed circuit board including a bracket.

11. A key striking force sensor according to claim 7, wherein the calculation means comprises first differentiating means for differentiating the measured displacement data in order to determine the velocity data for the hammer mechanism.

12. A key striking force sensor according to claim 11, wherein the calculation means further comprises second differentiating means for differentiating the calculated velocity data in order to determine the acceleration data for the hammer mechanism.

* * * * *